US008186123B2

(12) United States Patent
Klaffke et al.

(10) Patent No.: US 8,186,123 B2
(45) Date of Patent: May 29, 2012

(54) SLIDING WALL

(75) Inventors: Matthias Klaffke, Belm (DE); Uwe Niehausmeier, Rödinghausen (DE)

(73) Assignee: Solarlux Aluminium Systeme GmbH, Bissendorf (DE)

( * ) Notice: Subject to any disclaimer, the term of this patent is extended or adjusted under 35 U.S.C. 154(b) by 0 days.

(21) Appl. No.: 13/052,527

(22) Filed: Mar. 21, 2011

(65) Prior Publication Data

US 2011/0225901 A1 Sep. 22, 2011

(30) Foreign Application Priority Data

Mar. 22, 2010 (DE) ..... 10 2010 012 378

(51) Int. Cl.
*E04C 2/38* (2006.01)

(52) U.S. Cl. ..... 52/656.4; 52/207; 52/656.7; 49/462; 49/383

(58) Field of Classification Search ..... 52/243.1, 52/204.1, 207, 656.7, 656.4, 52, 54, 202, 52/3; 49/460, 462, 383, 384, 366, 370; 70/52, 70/54; 292/337, 346, DIG. 2
See application file for complete search history.

(56) References Cited

U.S. PATENT DOCUMENTS

| | | | | |
|---|---|---|---|---|
| 3,888,096 | A * | 6/1975 | Huss | 70/209 |
| 4,044,579 | A * | 8/1977 | Le Bel | 70/416 |
| 4,525,004 | A * | 6/1985 | Tanaka | 292/171 |
| 4,885,921 | A * | 12/1989 | Sharav | 70/159 |
| 5,203,187 | A * | 4/1993 | Kane | 70/455 |
| 6,308,474 | B1 * | 10/2001 | Wilson | 52/202 |

FOREIGN PATENT DOCUMENTS

DE 197 02 024 B4 9/2007

* cited by examiner

*Primary Examiner* — Brian Glessner
*Assistant Examiner* — Brian D Mattei
(74) *Attorney, Agent, or Firm* — Gudrun E. Huckett

(57) ABSTRACT

A sliding wall has at least one door provided with an actuating element for locking the door. A pinch protection device is connected to the door. The pinch protection device has a cover element having a covering position and an open position. The cover element is transferable from the covering position into the open position and from the open position into the covering position. A receiving space for accommodating functional elements of the door is provided. The cover element covers the receiving space in the covering position and in the open position opens the receiving space.

20 Claims, 3 Drawing Sheets

SLIDING WALL

BACKGROUND OF THE INVENTION

The invention relates to a sliding wall with at least one door that comprises an actuating element for locking the door and that is provided with a pinch protection device.

The sliding wall, usually referred to as a horizontal sliding wall, is provided with at least one door that can be locked in such a way that, when being used in its function as a door, it can be opened and closed but, when used in this function, cannot be moved slidably as a sliding wall element. The door is provided with a pinch protection device so that, when opening or closing the door, nobody can put his fingers accidentally into the slot that is created between the side of the door that does not swing open and the neighboring sliding wall element. Such a pinch protection device is in particular required in case of doors with an inwardly positioned pivot point, i.e., the pivot point is positioned inside the flat structure of the sliding wall system or frame, because otherwise even injuries such as sheared-off fingers may result. The pinch protection device therefore can also take on a shear-off protection. Such a sliding wall is disclosed in DE 197 02 024 B4.

Conventional sliding walls provided with such a pinch protection device have the disadvantage that on the pinch protection device the actuating elements for locking the door, usually to be found in this area of the door, can no longer be mounted because upon rotation of the door they would be in the way if they were seated on the pinch protection device. In case of such door elements of sliding walls, it has therefore already been proposed to not extend the pinch protection device all the way to the floor, to cut out a piece near the floor or to provide a hole, and then position the actuating element near the floor. Such a design is however not user-friendly. Also, it is not possible to release at the same time the locking action at the floor and carry out a further manipulation further upwardly, for example, to release an upwardly positioned locking action. Finally, for children who are playing on the floor the door cannot provide a pinch protection and injuries may result.

SUMMARY OF THE INVENTION

It is an object of the present invention to configure a sliding wall of the aforementioned kind with optimized safety features while providing a user-friendly design.

In accordance with the present invention, this is achieved in that the pinch protection device is provided with a cover element that can be moved from a covering position into an open position in which access to a receiving space for functional elements is released.

Since the pinch protection device comprises a cover element behind which a receiving space for the functional elements, for example, the actuating element, the door is substantially secured in all essential areas with a pinch protection and shear-off protection in the covering position of the cover element. The cover element, in contrast to conventional cutouts or holes, can be positioned at the normal grip height of a door because, in the covering position, it completes the pinch protection to a continuous element. The actuating element must no longer be displaced into user-unfriendly areas, for example, near the floor. The cover element can be opened and thus enables access to the receiving space positioned behind it.

Preferably, the cover element is connected to the remaining portion of the pinch protection device in a captive way such that upon opening it must not be put aside but remains connected to the pinch protection device. It may be designed to be slidable, but it is preferably pivotably connected to the remaining portion of the pinch protection device. As needed, it can be opened like a flap.

With respect to manufacture, it is particularly advantageous when the pinch protection device and the cover element are manufactured from the same profiled section element from which the cover element must be removed simply by means of one or several separating cuts. In this way, only a single profiled section molding tool is required and the cover element, as needed, can be manufactured to have different lengths or sizes, depending on where the separating cuts are performed. It is particularly advantageous when functional profiled section parts extend across the entire length of the pinch protection device so that upon separation of the cover element automatically areas are provided that, for example, serve as receptacles for an axis of rotation or a bolt of the cover element, that serve as a stop and counter stop for determining or setting a maximum opening position of the cover element, and/or that are provided with, for example, fixation elements for locking the cover element in the covering position.

In the receiving space that is covered by the cover element, not only the actuating element or actuating grip for locking the door may be disposed but also further functional elements such as actuating rods that are required as a connecting rod for the topside locking action of the door or other sliding wall elements.

According to the invention, the receiving space is referred to as a receiving space for functional elements because it is possible to house several functional elements therein but this is not a mandatory requirement. Even when there is only one functional element, for example, the actuating grip for locking the door, this is to be encompassed by the present invention. In addition to the already mentioned functional elements in the receiving space also further ones can be disposed therein, for example, a key pad for an alarm device, switches for exterior advertisement or the like.

DESCRIPTION OF THE PREFERRED EMBODIMENTS

Figure 2:
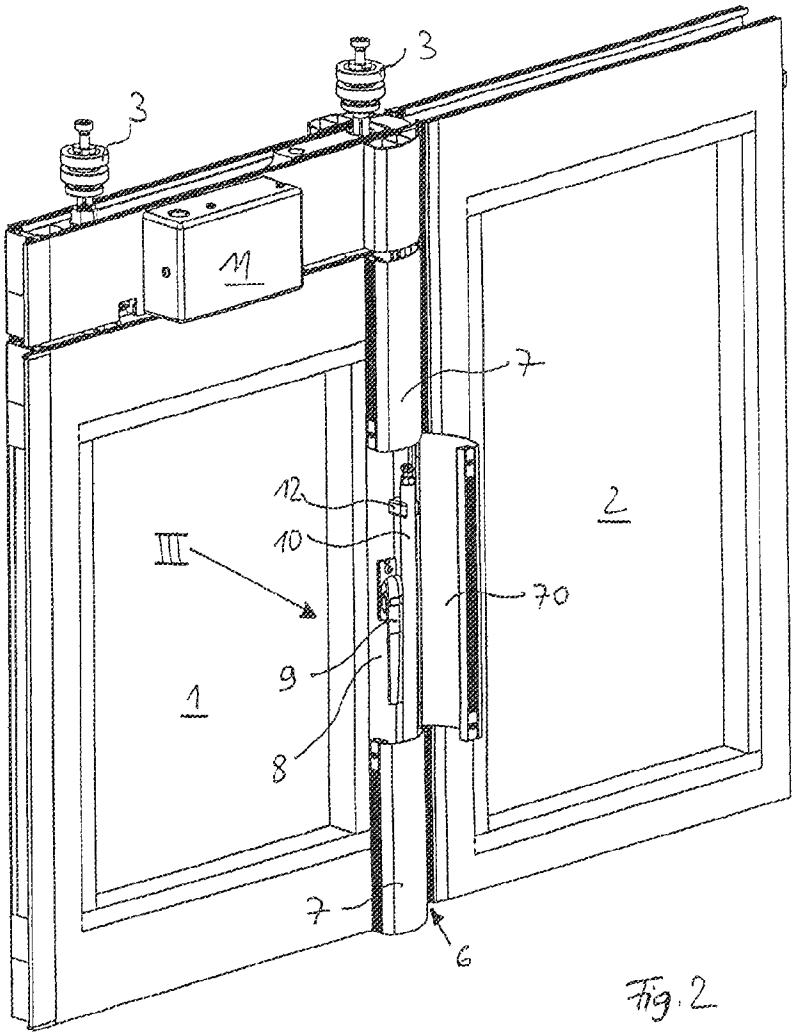
FIG. 2 shows the object of FIG. 1 with cover element in open position.
Figure 1:
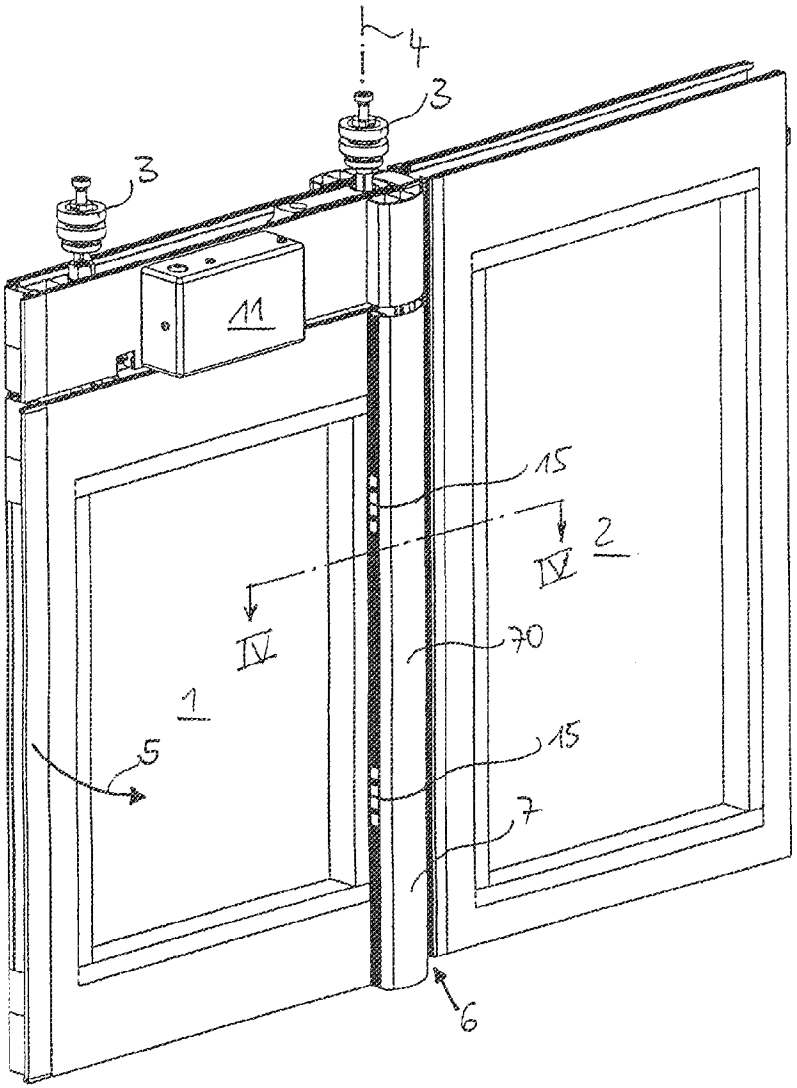
FIG. 1 shows a part of a sliding wall with a window element and a door element.

The part of a sliding wall that is illustrated in FIGS. 1 and 2 has a door 1 and a window element 2. The door 1 is rotatable about an axis of rotation 4 that is defined by one of the two track carriages 3. The window element 2 also comprises such track carriages which are however not illustrated in the drawing. When the door 1 pivots in the direction of arrow 5 upon being opened, the rear frame part pivots and rotates into the gap 6 between the door 1 and the window element 2. In order to eliminate in this situation the danger that fingers located in this area become pinched or even sheared off, the frame part of the door 1 has a pinch protection device 7 that extends across the entire height of the door. The pinch protection device 7 is preferably formed by a profiled section element that extends in a rounded shape about axis of rotation 4. When the door 1 is designed to pivot into an open position only in the direction of arrow 5, it would be sufficient to provide the pinch protection device 7 only on the front side that is facing the viewer in FIGS. 1 and 2. In the illustrated embodiment, the door 4 has such a pinch protection device 7 also on the rear side; this rear pinch protection device is present either for visual and symmetry reasons or in order to be able to use the door 1 as a swinging door.

Figure 3:
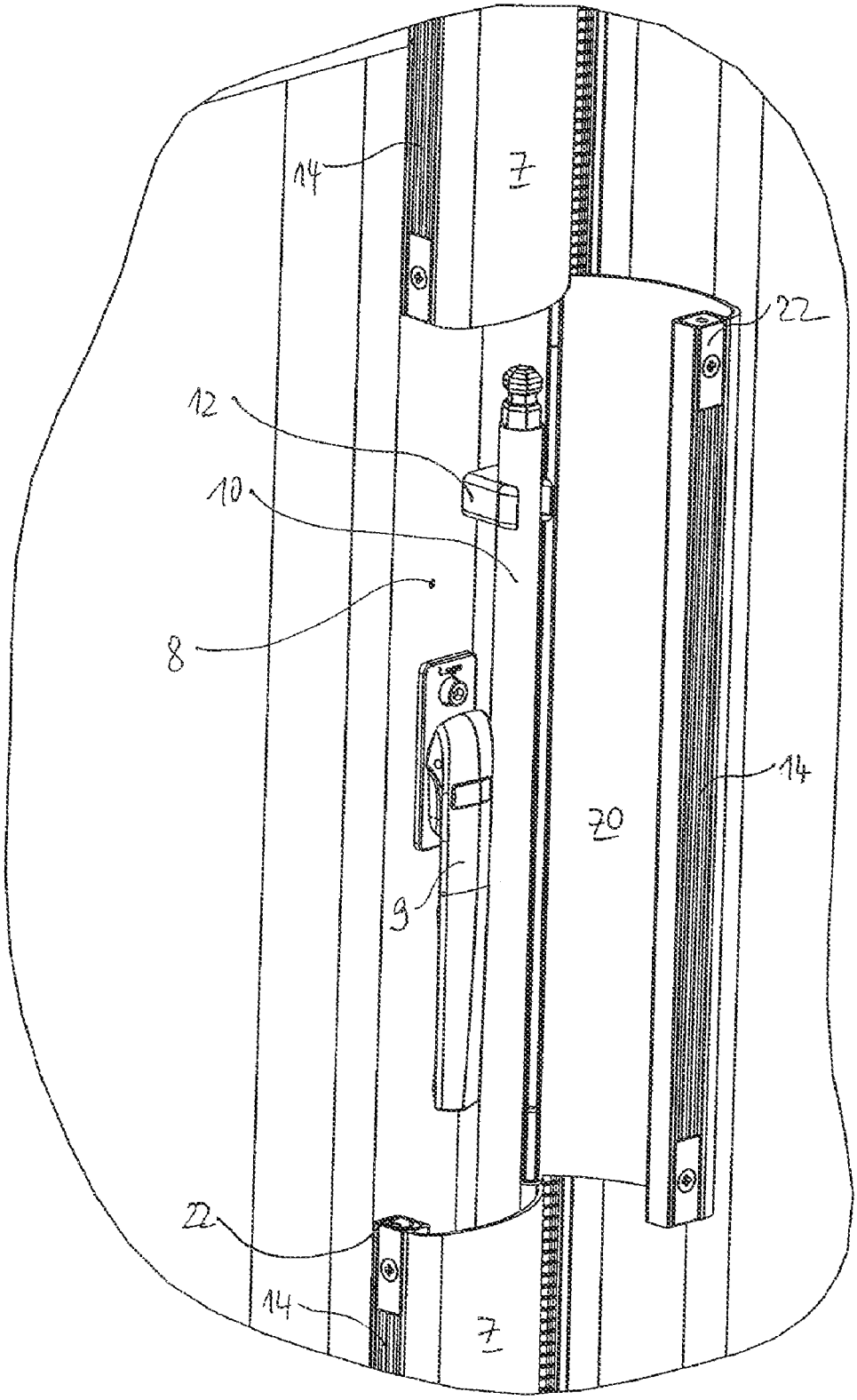
FIG. 3 shows detail III of FIG. 2.

Approximately at the level of the grip or handle of the door, the pinch protection device 7 has a cover element 70 that with respect to its outer geometry is preferably of identical design as the pinch protection device and is embodied, as illustrated, preferably as a flap. The cover element or flap 70 can be transferred into an open position illustrated in FIGS. 2, 3, and 5 and then enables access to the receiving space 8 in which, in the illustrated embodiment, the functional elements in the form of the actuating element or actuating grip 9 for locking the door and the actuating rod 10, here embodied as a connecting rod for engaging the upper locking box 11, are provided. For the connecting rod 10 a holder 12 is provided.

Figure 5:
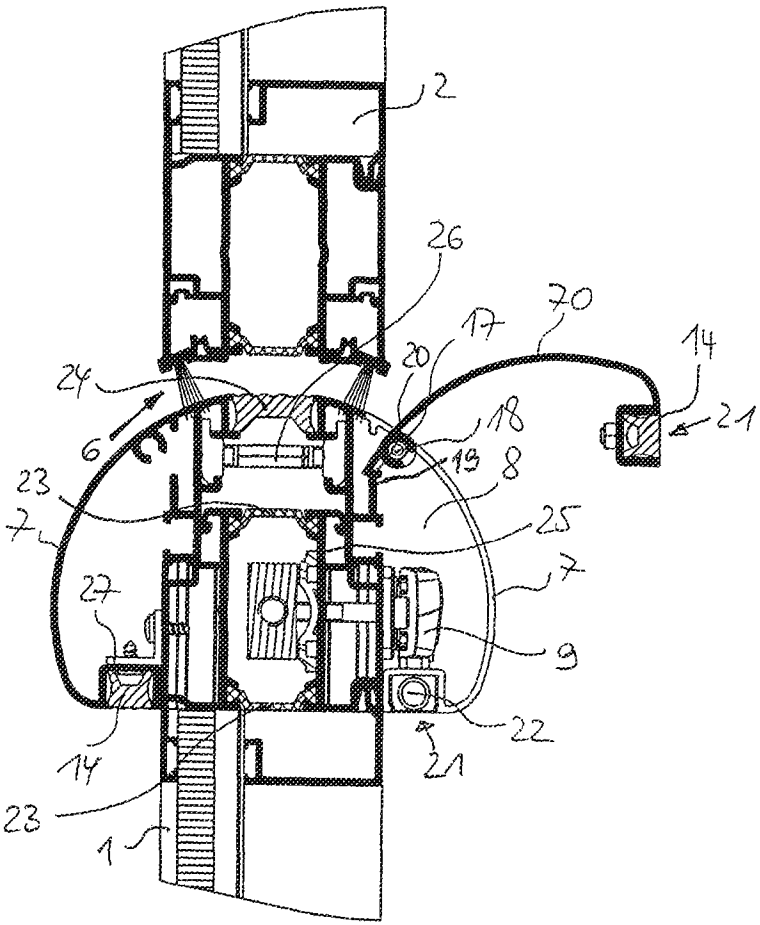
FIG. 5 shows the object of FIG. 4 with cover element in open position.
Figure 4:
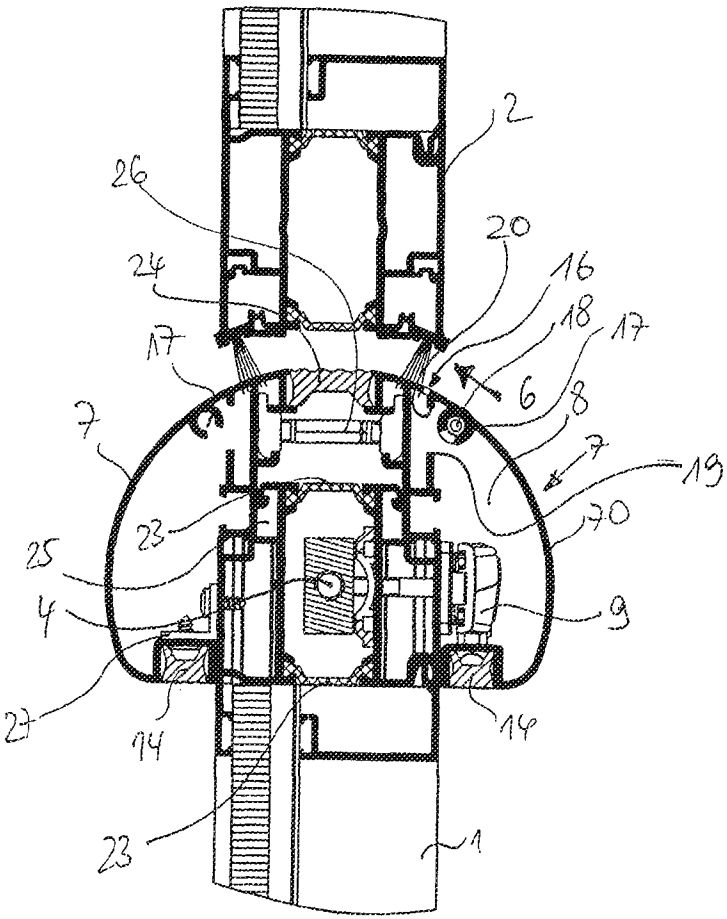
FIG. 4 is a section view in the direction IV-IV of the object of FIG. 1.

Details of the cover element 70 and its function are recognizable in particular in FIGS. 4 and 5. It is particularly advantageous when the cover element 70, as shown in the illustrated embodiment, is formed of the profiled section element of the pinch protection device 7 by being cut out or separated from it. For this purpose, separating cuts at the positions 15 (see FIG. 1) and 16 (see FIG. 4) are required. It is however also conceivable to provide an embodiment with an interruption of the pinch protection device 7 at the positions 15, 16 and with a separate profiled section design of the cover element 70 wherein the cover element 70 preferably has identical outer geometry with the pinch protection device 7.

The thus formed flap 70 is preferably pivotably connected to a rigid part of the pinch protection device 7. In the illustrated embodiment, this is realized in that the profiled section element has a receptacle 17 for an axis of rotation 18 of the flap 70. This axis of rotation 18 is preferably formed by simple socket pins.

Also immediately provided by means of the profiled section element are projections 19 and 20 that provide a stop and counter stop for defining the maximum opening position of the flap 70 (see FIG. 5).

Moreover, the configuration of the profiled section element may provide a cutout 21 in which a fixation element 22, here preferably a ball catch, for locking the cover flap 70 in the covering position is received. Across the remaining length of the pinch protection device 7 and the cover element 70 a rubber seal 14 is provided in this cutout 21 and ensures improved friction or grip at the cover flap 70 for opening the flap 70 and, outside of the flap 70, covers or hides possible screw connections or attachment means of the pinch protection device 7 with the profiled section element of the frame or the wing positioned underneath. The pinch protection device 7 or the flap 70 itself may have a safety device, not illustrated, against accidental or unauthorized opening of the cover element 70. For example, the flap 70 can be designed to be lockable. For this purpose, a small lock can be arranged also within the cutout 21.

In the illustrated embodiment, the door 1 is embodied as a thermally insulated frame door with inner and outer profiled frame sections 25 and a thermal separation that is provided by insulating webs 23. On the profiled frame sections 25 the profiled section elements of the pinch protection device 7 are secured with angled fastening members 27 and additionally secured at certain spots by connecting fittings 26. A rubber seal 24 between the profiled section elements of the pinch protection device 7 provides a thermal separation and closes off the external contour of the pinch protection device 7 so that no dangerous opening or slot is formed.

Other embodiment variants are also possible. For example, the profiled section elements of the pinch protection devices 7 at both sides may be thermally separated but embodied so as to be connected permanently. The profiled frame section half 25 and the respective profiled section half of the pinch protection device 7 may also be embodied as a single part (monolithic) but thermally separated. Also, a "cold variant" without thermal separation is possible where all components are of a monolithic (one-part) configuration. Finally, the profiled wing section 25 can be of a monolithic (one-part) configuration while the pinch protection device 7 can be attached thereto and is of a monolithic (one-part) or a two-part configuration.

In any case, the embodiment according to the invention with the cover element 70 that can be opened and with the receiving space 8 for functional elements that is arranged behind the cover element 70, a significant advantage with respect to operating comfort is obtained without causing any loss in pinch protection.

The specification incorporates by reference the entire disclosure of German priority document 10 2010 012 378.1 having a filing date of Mar. 22, 2010.

While specific embodiments of the invention have been shown and described in detail to illustrate the inventive principles, it will be understood that the invention may be embodied otherwise without departing from such principles.

What is claimed is:

1. A sliding wall comprising:

a first sliding wall element and a second sliding wall element, wherein the first sliding wall element is a door that is positioned adjacent to the second sliding wall element;

wherein the door is pivotable relative to the second sliding wall element about an axis located at a longitudinal side of the door facing the second sliding wall element;

wherein between the longitudinal side of the door and the second sliding wall element a gap is formed;

wherein the door is provided with an actuating element for locking the door;

a pinch protection device connected to the longitudinal side of the door and extending across the entire height of the door to prevent access to the gap;

wherein the pinch protection device comprises a cover element having a covering position and an open position and transferable from the covering position into the open position and from the open position into the covering position;

a receiving space inside the pinch protection device for accommodating functional elements of the door;

wherein the cover element covers the receiving space in the covering position and opens the receiving space in the open position; wherein the actuating element of the door is arranged in the receiving space.

2. A sliding wall comprising: according to claim 1, a first sliding wall element and a second sliding wall element, wherein the first sliding wall element is a door that is positioned adjacent to the second sliding wall element;

wherein the door is pivotable relative to the second sliding wall element about an axis located at a longitudinal side of the door facing the second sliding wall element;

wherein between the longitudinal side of the door and the second sliding wall element a gap is formed;

wherein the door is provided with an actuating element for locking the door;

a pinch protection device connected to the longitudinal side of the door and extending across the entire height of the door to prevent access to the gap;

wherein the pinch protection device comprises a cover element having a covering position and an open position and transferable from the covering position into the open position and from the open position into the covering position;

a receiving space inside the pinch protection device for accommodating functional elements of the door;

wherein the cover element covers the receiving space in the covering position and opens the receiving space in the open position;

wherein the cover element is pivotably supported on a rigid part of the pinch protection device.

3. The sliding wall according to claim 1, comprising a holder for a removable actuating rod, wherein the holder is arranged in the receiving space.

4. The sliding wall according to claim 1, wherein the pinch protection device is formed of a profiled section element and wherein the cover element is a part that has been cut by separating cuts from the profiled section element.

5. The sliding wall according to claim 4, wherein the profiled section element has a receptacle for an axis of rotation of the cover element.

6. The sliding wall according to claim 5, wherein the receptacle extends continuously along a length of the profiled section element.

7. The sliding wall according to claim 4, wherein the profiled section element comprises projections forming a stop and a counter stop that determine a maximum open position of the cover element.

8. The sliding wall according to claim 7, wherein the projections extend continuously along a length of the profiled section element.

9. The sliding wall according to claim 4, wherein the profiled section element has a cutout for fixation elements for locking the cover element in the covering position.

10. The sliding wall according to claim 9, wherein the cutout extends continuously along a length of the profiled section element.

11. The sliding wall according to claim 1, wherein the pinch protection device comprises a securing means against accidental and/or unauthorized opening of the cover element.

12. A sliding wall comprising:

a first sliding wall element and a second sliding wall element, wherein the first sliding wall element is a door that is positioned adjacent to the second sliding wall element;

wherein the door is pivotable relative to the second sliding wall element about an axis located at a longitudinal side of the door facing the second sliding wall element;

wherein between the longitudinal side of the door and the second sliding wall element a gap is formed;

wherein the door is provided with an actuating element for locking the door;

a pinch protection device connected to the longitudinal side of the door and extending across the entire height of the door to prevent access to the gap;

wherein the pinch protection device comprises a cover element having a covering position and an open position and transferable from the covering position into the open position and from the open position into the covering position;

a receiving space inside the pinch protection device for accommodating functional elements of the door;

wherein the cover element covers the receiving space in the covering position and opens the receiving space in the open position;

wherein the pinch protection device is formed of a profiled section element and wherein the cover element is a part that has been cut by separating cuts from the profiled section element.

13. The sliding wall according to claim 12, wherein the profiled section element has a receptacle for an axis of rotation of the cover element.

14. The sliding wall according to claim 13, wherein the receptacle extends continuously along a length of the profiled section element.

15. The sliding wall according to claim 12, wherein the profiled section element comprises projections forming a stop and a counter stop that determine a maximum open position of the cover element.

16. The sliding wall according to claim 15, wherein the projections extend continuously along a length of the profiled section element.

17. The sliding wall according to claim 12, wherein the profiled section element has a cutout for fixation elements for locking the cover element in the covering position.

18. The sliding wall according to claim 17, wherein the cutout extends continuously along a length of the profiled section element.

19. The sliding wall according to claim 2, wherein the pinch protection device is formed of a profiled section element and wherein the cover element is a part that has been cut by separating cuts from the profiled section element.

20. The sliding wall according to claim 19, wherein the profiled section element has a receptacle for an axis of rotation of the cover element.

* * * * *